United States Patent [19]

Alvarez

[11] Patent Number: 4,555,111

[45] Date of Patent: Nov. 26, 1985

[54] PRACTICE BAT

[76] Inventor: Manuel R. Alvarez, 3052 Nevada St., El Monte, Calif. 91731

[21] Appl. No.: 526,602

[22] Filed: Aug. 26, 1983

[51] Int. Cl.[4] ..... A63B 69/40

[52] U.S. Cl. ..... 273/26 B; 273/29 A

[58] Field of Search ..... 273/29 A, 26 R, 26 B, 273/194 R, 67 R, 72 R, 193 B, 77, 94, 87.2, 87.4; 272/76, 137, 142, 138, 140, 68, 143; 403/229; 464/51, 52, 53

[56] References Cited

U.S. PATENT DOCUMENTS

| | | | |
|---|---|---|---|
| 979,985 | 12/1910 | Moorhead | 464/53 |
| 1,803,134 | 4/1931 | Renn | 273/87.4 |
| 2,714,008 | 7/1955 | Urban | 272/137 |
| 3,428,325 | 2/1969 | Atkinson | 273/26 B |
| 3,451,675 | 6/1969 | Burzenski | 272/137 |
| 4,249,729 | 2/1981 | Gabrielidis | 273/29 A |
| 4,399,996 | 8/1983 | Boyce | 273/26 B |

FOREIGN PATENT DOCUMENTS

| | | | |
|---|---|---|---|
| 20655 | of 1894 | United Kingdom | 403/229 |

*Primary Examiner*—Richard C. Pinkham
*Assistant Examiner*—T. Brown
*Attorney, Agent, or Firm*—Harlan P. Huebner

[57] ABSTRACT

A practice bat for baseball players including a handle portion, and a weighted end portion interconnected by a resilient spring. The weighted end portion is remote from the hands of the player holding the handle portion so that when the bat is swung the momentum of the weighted end portion will cause it to lag behind and then move ahead of a longitudinal at rest axis of the handle portion causing the player's wrists to break or bend.

2 Claims, 9 Drawing Figures

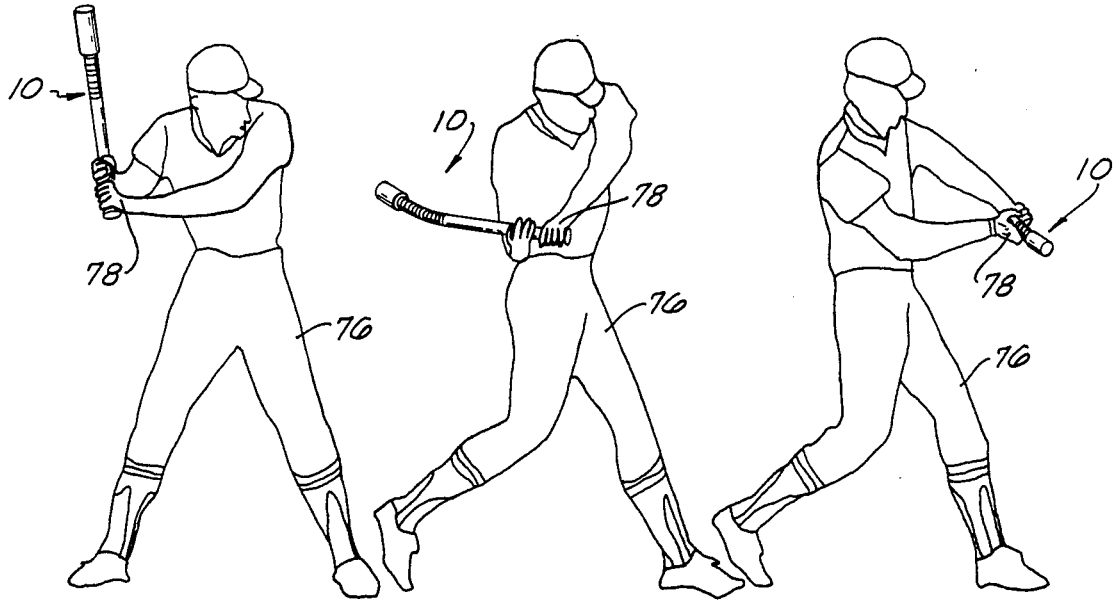
FIG. 1a. FIG. 1b. FIG. 1c.
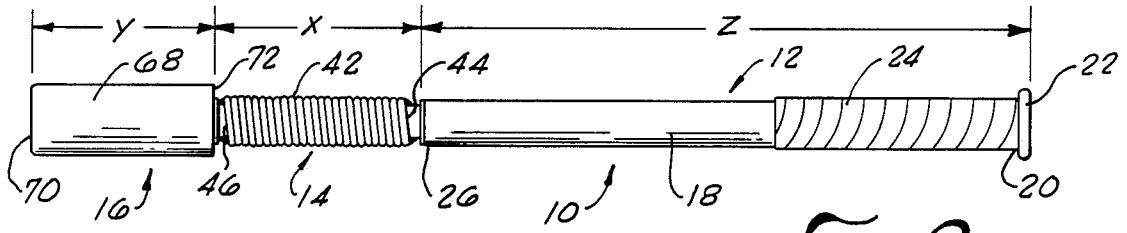
FIG. 2.
FIG. 3.
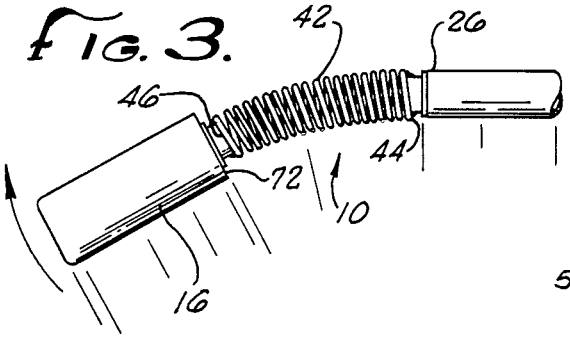
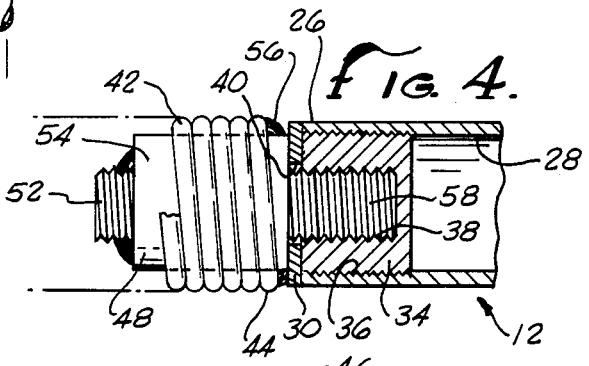
FIG. 4.
FIG. 6.
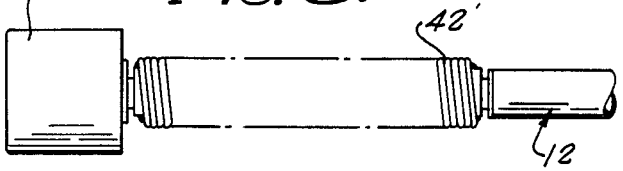
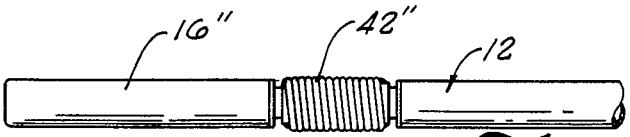
FIG. 7.
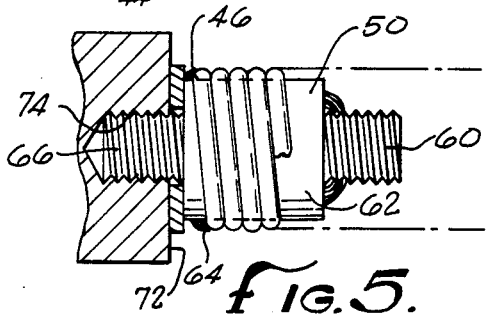
FIG. 5.

PRACTICE BAT

BACKGROUND OF INVENTION

This invention is directed to a practice bat to be used by baseball players to warmup and particularly to aid them in breaking or snapping the wrists ahead of the arms during a swing which action will help to achieve the maximum hitting stroke.

Heretofore the best known practice device for batters has been the use of metal rings which slide on a conventional bat toward the hitting end of the bat. As the player swings the bat the weighted end will assist to a limited extent in breaking the wrists and warming up.

It has been found that by breaking or snapping the wrists ahead of the arms at the point a bat impacts a baseball, there will be added greater distance to the ball when hit.

There are certain other prior art devices which endeavor to assist the batter, but each lacks the true ability to force a breaking of the wrists. In Kennedy U.S. Pat. No. 537,927 and Kennedy No. 546,540 a rubber cushion is inserted in the middle of a conventional baseball bat which is suppose to cushion the blow when the ball is hit. The bat is not for practice nor intended to flex or bend. In Salisbury, U.S. Pat. No. 3,246,894 the practice bat of this patent is only to help a batter assume the proper position when contacting the baseball. There is no flexing or breaking of the end of the bat as in the present invention. In Green, U.S. Pat. No. 3,173,688 the bat illustrated is only to similate the noise of a baseball as it is hit by a bat. The bat is not a practice bat to assist a batter in breaking his wrists during a warmup.

SUMMARY OF THE INVENTION

It is a purpose of the present invention to provide a practice baseball bat to be used during a batter's warmup which includes a weighted end portion which is flexible so that during the bat swing momentum will cause the end to pivot or flex backward and then forward of a normal longitudinal plane of a baseball bat. This will cause the hands of the batter to first bend rearwardly of the arms and then forwardly at the point of contact or slightly thereafter on the hollow through.

A further object is to provide a handle portion of a baseball bat and a weighted end portion in which the two parts are joined by a resilient member.

Another object of the invention is to provide weighted end portions of different weight or sizes dependant upon the size of the person using the practice bat.

A still further object of the invention is to provide resilient means of varying stiffness depending upon the size of the person using the practice bat.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

The above advantages may be more clearly understood from the following detailed description and by reference to the drawings in which:

FIGS. 1*a*, 1*b*, 1*c* are progressive figures of a batter swinging the practice bat of the present invention from the starting position partially through the swing;

FIG. 2 is a side elevational view of the entire practice bat;

FIG. 3 is a top elevational view of the head or end weighted portion and resilient means of the practice bat wherein the weight is flexed rearwardly from a common longitudinal center line of the bat due to momentum during a swing with the bat;

FIG. 4 is a side elevational view partly in section of the attachment means for securing the resilient means to the handle portion of the bat;

FIG. 5 is a side elevational view partly in section of the attachment means for securing the resilient means to the weighted end means of the bat;

FIG. 6 is a modified practice bat of FIG. 2;

FIG. 7 is a further modified practice bat of FIG. 2.

DETAILED DESCRIPTION OF THE PREFERRED EMBODIMENT

Now referring specifically to FIGS. 2 through 5 there is illustrated a practice bat generally designated 10. The bat 10 is generally divided into three pieces, a handle portion 12, a resilient portion 14 and a weighted end portion 16.

In construction the handle portion 12 may be made of hollow aluminum or from conventional solid oak wood. The handle is enlongated and has an exterior round surface 18. At the lower end 20 there is preferably a round conventional hand stop 22 against which the heel of the right or left hand rests when the bat 10 is gripped. It is also preferable that a portion of the handle 12 be wrapped with wrapping 24 from the hand stop 22 upward a distance at least as great as the width of two hands. The wrapping will facilitate the holding of the practice bat 10.

In addition, the diameter of the handle 12 may deminish from upper end 26 to end 20 as with a conventional baseball bat of it may be of one diameter along its length.

In the illustration of FIG. 4 the handle 12 is of a hollow construction wherein there is an internal diameter 28 and an end plate 30 secured to end 26. Mounted within the end 26 of the handle 12 are securing means 32 for maintaining the resilient means 14 to the handle 12. The means 32 includes an annular plug 34 which can be threadable secured inside the handle by threads 36 or swedged therein. The plug 34 also includes a central threaded bore 38 and there is an opening 40 in plate 30 aligned with the bore 38.

The resilient means 14 preferably includes a coil spring 42 having a number of convolutions with a bottom end 44 and a top end 46 having attachment means 48 and 50 extending from the respective ends 44 and 46, see FIGS. 4 and 5. The means 48 has a threaded shaft 52 which passes outwardly through a lock nut 54 beyond the end 44 of the spring 42. The nut 54 may be welded at 56 or otherwise secured to the spring so that the spring 42 and shaft are fixed. The end 58 of the shaft that projects outward is threadably secured to the handle within the threaded bore 38.

At the opposite end 46 of the spring 42 an additional threaded shaft 60 passes outwardly through a lock nut 62 beyond the spring end 46. The nut 62 may also be welded at 64 or otherwise secured to the ring so that the spring 42 and shaft are fixed. The end 66 of the shaft 60 that projects outward is treadably secured to handle 12 within a bore in the weighted end portion 16.

The weighted end portion 16 is preferably made of steel and is a solid annular weight 68 having an upper or outer end 70 and lower or inner end 72. The end 72 is drilled to form a threaded central bore 74. The end 66 of the spring attaching means 50 can be secured in the bore 74 to unite the weighted end portion 14 with the coil spring 42, see FIG. 5.

In practice, a batter 76 will grip the practice bat 10 as a conventional bat and swing the same to limber up his body as well as to practice breaking or bending the wrists. As can be seen in FIGS. 1*a*, 1*b* and 1*c* the progression is to hold the bat at the ready as in FIG. 1*a*. As the batter 76 starts to swing the weighted end 16 being heavy and connected to the coil spring 42 will remain behind the hands 78 and be flexed backward from a common longitudinal axis of the bat 10 when it is at rest, see FIG. 1*b*. As the swing continues, FIG. 1*c*, the momentum of the heavy weight will cause the spring 42 and weight to move or flex forward of the common longitudinal axis causing the wrists to break ahead of the bat which is desired to achieve a proper and complete baseball swing. After the swing is finished the coil springs 42 being resilient the spring 42 and the weighted end portion 16 will return to the common longitudinal in line axis, such as seen in FIG. 2.

The batter 76 may continue with as many practice swings as he likes being forced to break or snap the wrists by the momentum of the weighted end portion 16 as spring 42 flexes and the weight moves back and then ahead of the hands in the swing arc.

FIGS. 6 and 7 illustrate modifications in the weighted end portions 16' and 16'' and the coil spring members 42' and 42''.

The coil spring 42' of FIG. 6 is generally longer than the length, represented by the arrow x in FIG. 2, of coil spring 42 and as such it will be less stiff allowing a bending of the same with less effort such as by a smaller person. In addition the weighted end portion 16' while preferable annular is thicker in diameter but less in length than the weight 68, the length being represented by the arrow y in FIG. 2.

In FIG. 7 another modification is shown where the length x of coil spring 42'' is less than either of the lengths of springs 42 or 42'. This would normally create a very stiff bending joint. To compensate for this it then would be feasible to increase the length y of the weighted end portion 16'' over portions 16 and 16'.

No illustration of varying lengths, represented by arrow z—FIG. 2, of the handle portion 12 are shown but it should be appreciated that the length z can also be reduced or extended.

In view of the varying lengths x, y, and z, as well as flexibility of the spring 42 dependent upon the diameter of the wire making up each convolution of spring 42 and the amount of weight of the weighted end portion 16 the bat 10 can be designed for use by persons from Little League to professionals.

As a safety measure in the event of crystallization of the coil spring 42 the inventor contemplates the use of a safety wire (not shown) that can extend between and be secured to the respective threaded shafts 52 and 60 to prevent separation of the parts.

While the preferred embodiment of the practice bat 10 has illustrated a hollow aluminum handle portion 12, if a solid wood handle portion is used the annular plug 34 can be secured in the wood by any appropriate means to prevent turning.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A baseball practice bat capable of being adjusted to the individual needs of a particular person during warmup to assist the person in snapping both wrists upon follow through during a swing of the arms comprising:

an elongated handle portion of a length to receive both hands of a person and the handle portion has inner and outer ends with a hand stop formed at said outer end;

a replaceable weighted end portion including outer and inner ends wherein said weighted end portion is annular and of a lesser length than said handle portion, and the hands are not to engage said weighted end portion when said practice bat is swung;

a replaceable enlongated coil spring of at least several convolutions and having opposed ends, said spring interposed by releaseable securing means between said weighted end portion and the inner end of said handle portion;

said releaseable securing means including plug means with a threaded bore in said inner end of said handle portion and a threaded bore in the inner end of said weighted end portion and threaded shafts projecting from each end of said coil spring ends engageable with said threaded bores for releaseable maintaining the handle portion, coil spring and weighted end portion together in an in line arrangement; and said in line arrangement creating a bat wherein all the parts have an elongated axis extending therethrough when in an at rest position, but upon swinging the same flexing at least a part of the coil spring and the weighted end portion rearward and forward of said axis due to the momentum of the weight in relation to the hands during said swing whereby both wrists of said person will snap.

2. A practice bat as defined in claim 1 wherein said elongated coil spring is of a length less than the length of said handle portion.

* * * * *